US006129997A

United States Patent [19]

Braun et al.

[11] Patent Number: 6,129,997

[45] Date of Patent: Oct. 10, 2000

[54] METHOD FOR MANUFACTURING A WELDED SHAPED BODY DISPERSION-HARDENED PLATINUM MATERIAL

[75] Inventors: Franz Braun, Gelnhausen; Wulf Kock, Alzenau; David Francis Lupton, Gelnhausen, all of Germany

[73] Assignee: W. C. Heraeus GmbH & Co. KG, Hanau, Germany

[21] Appl. No.: 09/266,142

[22] Filed: Mar. 10, 1999

[30] Foreign Application Priority Data

Mar. 28, 1998 [DE] Germany ..... 198 13 988

[51] Int. Cl.[7] ..... B32B 15/01

[52] U.S. Cl. ..... 428/670; 148/678; 148/280; 148/281; 148/276; 148/277

[58] Field of Search ..... 148/678, 280, 148/281, 276, 277; 428/670

[56] References Cited

U.S. PATENT DOCUMENTS

| | | | |
|---|---|---|---|
| 3,139,682 | 7/1964 | Grant | 29/552.2 |
| 3,640,705 | 2/1972 | Selman et al. | 75/172 |
| 3,696,502 | 10/1972 | Darling | 29/527.7 |
| 3,709,667 | 1/1973 | Selman et al. | 29/182.5 |
| 4,252,558 | 2/1981 | Touboul et al. | 75/5 |
| 4,738,389 | 4/1988 | Moshier et al. | 228/198 |
| 4,819,859 | 4/1989 | Schwenninger | 228/190 |

FOREIGN PATENT DOCUMENTS 1 533 273 2/1970 Germany .

OTHER PUBLICATIONS

Shojiro Ochiari, "Mechanical properties of Metallic Composites", 1993, pp. 352–353.

*Primary Examiner*—Daniel J. Jenkins
*Assistant Examiner*—Nicole Coy
*Attorney, Agent, or Firm*—Frishauf, Holtz, Goodman, Langer & Chick, P.C.

[57] ABSTRACT

A method is provided for manufacturing a welded shaped body of platinum material dispersion-hardened by finely divided small particles of base metal oxide, especially such a body provided with at least one inside wall, such as a tube. The base metal oxide is one or more oxides of the elements yttrium, zirconium and cerium. The method includes shaping and welding of at least one part, especially a sheet, of an alloy of platinum and base metal, to a preform body, e.g. a tube. The preform body is then subjected to heat treatment in an oxidizing medium until the minimum degree of oxidation of the base metal reaches 75 wt %. The preform body is then formed into the desired product.

15 Claims, No Drawings

METHOD FOR MANUFACTURING A WELDED SHAPED BODY DISPERSION-HARDENED PLATINUM MATERIAL

BACKGROUND OF THE INVENTION

The invention relates to a method for manufacturing a welded shaped body of platinum material dispersion-hardened by finely divided small particles of base metal oxide, especially such a body provided with at least one inside wall, e.g. a tube. The invention also relates to a shaped body, especially a tube, made by the method and to the use of such a tube.

It is known from the prior art (see German Patent Application DE-OS 15 33 273) that platinum, palladium and rhodium as well as alloys thereof containing a small proportion of one or more dissolved base metals can be subjected to internal oxidation to create a dispersion-hardened material.

In this process a small quantity of at least one base metal capable of forming a stable heat-resistant compound is alloyed into platinum, palladium or rhodium or alloys of these metals containing one or more other metals of the platinum group, after which the alloying additive is transformed to the heat resistant compound which is dispersed through the alloy. Examples of suitable base metals are chromium, beryllium, magnesium, aluminum, silicon, the rare earths, thorium, uranium and metals of the first, second and third subgroups of the periodic table, calcium to nickel, strontium to molybdenum and barium to tantalum. The heat-resisting compound can be an oxide, a carbide, a nitride, a silicide, a boride, a sulfide or any other heat resisting compound which can be formed by interaction between a gaseous phase and the base metal.

It is also known from the prior art (see German Patent Application DE-OS 15 33 273) that sheets of a metal of the platinum group or alloys thereof can exist in dispersion-hardened form with an addition of the above nonmetallic compounds.

However, it is also known ("Mechanical Properties of Metallic Composites," edited by Shojiro Ochiai, 1993, pages 352–353) that, during welding of oxide-dispersion-hardened platinum materials, the oxide dispersion hardening is largely lost. This is due to the melting process during welding which leads to agglomeration and washing-out of the oxide dispersoids and thus to loss of the favorable characteristics. As also discussed, this has led to attempts to fabricate items from the platinum materials without using hot welding techniques.

Usually platinum materials with fine-grained equiaxial microstructure are used in the manufacture of components. This microstructure is created by forming (forging or rolling, for example) a smelted and cast bar and then subjecting it to recrystallization annealing. If the material is subsequently welded, the microstructure developed in the weld after solidification of the metal is more like the undesired microstructure in cast bars than with the fine-grained microstructure of the rest of the material, which was obtained by the recrystallization annealing. The microstructure can be homogenized (that is, a more uniform structure can be formed) by forming the weld together with the rest of the material, and this becomes apparent after recrystallization annealing treatment, in that the formed and recrystallized material of the weld corresponds substantially to the rest of the material.

It was not possible heretofore to apply the welding method to oxide-dispersion-hardened materials without losing the specific characteristics of dispersion hardening.

Since the welding process leads to washing-out of the dispersoids, as already explained hereinabove, the weld differs fundamentally from the rest of the material.

On the one hand, the hardening effect of the dispersoids will no longer be present. On the other hand, the microstructure (grain size) in the largely oxide-free weld will become substantially coarser than in the rest of the material during an annealing treatment or during service at high temperature. (The presence of dispersoids leads to considerable stabilization of the grain structure). Even after forming and annealing treatment, the coarsened grain size in the weld leads among other problems to increased corrosion susceptibility, since corrosion attack takes place mainly along the grain boundaries.

Furthermore, it was not possible heretofore to achieve a high proportion of internal oxidation in relatively thick semifinished products of platinum materials, especially with thicknesses of several millimeters. For this reason such semifinished products had to be made from a material which already contains the oxide dispersoids and thus suffers from the above-mentioned problems during welding.

It is therefore an object of the invention to eliminate at least partly the aforesaid disadvantages by means of a novel method, a novel shaped body and a use thereof.

SUMMARY OF THE INVENTION

A method for manufacturing a welded shaped body comprising platinum material dispersion-hardened by finely divided small particles of base metal oxide, especially such a body provided with at least one inside wall, especially a tube, wherein the base metal oxide is one or more oxides of the elements yttrium, zirconium and cerium, with the following process steps:

shaping and welding of at least one part, especially a sheet, of an alloy of platinum and base metal, to a preform body, especially to a tube, heat treatment of the preform body in an oxidizing medium until the minimum degree of oxidation of the base metal reaches 75%, forming of the preform body.

DETAILED DESCRIPTION

In the method according to the invention, a blank of arbitrary shape comprising an alloy of platinum and base metal doped with yttrium and zirconium and/or cerium is first placed in a preform, in which process a sheet in particular is rounded to the form of a tube and the opposite ends are welded together. Such welding can be performed either without filler metal or with a like filler metal. By the term "like filler metal" it is meant that, if addition of weld metal is necessary during welding, this metal should be similar to the parent metal, or in other words should be alloyed with the specified base metal doping elements, which in the present case are zirconium and yttrium, and/or cerium. In principle, it would be conceivable to weld a platinum (zirconium, yttrium) parent metal with a platinum (cerium) filler metal. Normally it is better to use a filler metal with the same primary and doping constituents as in the parent metal. In this way it is ensured that the oxidation kinetics in the weld and parent metal are largely identical, as is the resulting microstructure.

The shaped body still contained in the preform is then heat-treated in an oxidizing medium until the minimum degree of oxidation of the base metal reaches 75 wt %. Preferred oxidizing media are an atmosphere of air, oxygen, steam or a mixture of steam and hydrogen, inert gas, especially helium or argon, or nitrogen preferably being used. The temperature range for the oxidizing media is preferably from 800 to 1200° C. and the pressure is advantageously 1 to 10 atmospheres.

As a practical matter, air is used as the oxidizing medium. Since the oxide-forming base metal constituents are highly reactive, they can extract the oxygen necessary for forming the oxides from air or even from other oxygen-containing atmospheres such as steam. The oxygen-containing medium must be able to give up oxygen to the base metal constituents, or in thermodynamic terms the zirconium-yttrium oxide and cerium oxide must be more stable than the oxygen-containing species in the medium. To ensure that the rate-determining step will be diffusion in the platinum material and not oxygen supply from the medium, a sufficient concentration of the oxygen-containing species should be present. The necessary amount can be determined by simple stoichiometric calculation but, as a practical matter, an adequate oxygen supply is attained by flowing the media through the chamber until the reaction is complete.

In the method according to the invention, the doped but unoxidized material is welded first, and then the oxide dispersoids are formed by heat treatment in an oxidizing medium.

Internal oxidation is sufficiently accelerated by the use of the base metals yttrium, zirconium and cerium that the oxidation treatment can be performed on the shaped and welded preform body.

The formation of oxide particles is influenced only slightly by the grain structure of the platinum material, meaning that the only substantial difference between the weld and the parent metal lies in the grain structure and not in the distribution of oxide particles.

Depending on the desired final shape, the shaped body contained in the preform is then formed appropriately, for example by rolling, forging or elongating, in which connection the roll-pressure process has proved particularly useful in elongating.

Tubes comprising dispersion-hardened platinum material can be made in almost any desired size with the method according to the invention.

Advantageously the formed preform body is subjected to recrystallization annealing treatment in order to minimize dimensional changes during service. Furthermore, the homogeneity of microstructure between weld and parent metal is made more obvious by this treatment. The welded microstructure treated in this way and the dispersion-hardened platinum material no longer differ substantially from each other as far as their characteristics are concerned.

It has proved advantageous when the annealing treatment is performed at a minimum temperature of 600° C. and a maximum temperature of 1400° C. For oxide-dispersion-hardened, otherwise unalloyed platinum, the annealing treatment can be performed at any desired temperature of ≧600° C. For PtRh, PtAu and PtIr alloys—which are alloys of platinum with noble metals—temperatures of ≧900° C. and often of ≧1000° C. are necessary. To achieve a homogeneous, relatively fine recrystallized grain structure, temperatures of 1200° C. are normally not exceeded. However, the annealing treatment can in principle also be performed at still higher temperatures, because the oxide dispersoids prevent excessive grain growth. A temperature of 1400° C. has been found to be a practical upper limit. If the material is exposed to too high temperature before the oxide dispersoids have been formed by internal oxidation, undesired coarse-grain formation can occur.

It is further advantageous, during forming of the preform, especially during elongating, to achieve a reduction of at least 50% in wall thickness, since then there is almost no further difference between the characteristics of the welded microstructure and of the dispersion-hardened platinum material.

For conventionally made preform bodies, it would normally be expected that a wall-thickness reduction of at least 50% after welding of a dispersion-hardened material would lead to zones which react very differently to high-temperature aging (annealing treatment or service conditions). It would also be expected that the grain-stabilizing effect of the dispersoids in the weld would then be almost nonexistent and that coarse-grain formation would occur.

Since the dispersoids are formed only after welding, however, the formed preform body has homogeneous microstructure.

It has also proved advantageous for the base metal content of the alloy comprising platinum and base metal to be 0.005 to 1 wt % and for the dispersion-hardened platinum material to comprise dispersion-hardened platinum-rhodium alloy, dispersion-hardened platinum-iridium alloy or dispersion-hardened platinum-gold alloy.

Finally, it has proved advantageous for the alloy comprising platinum and base metal to be doped with 0.1 to 0.2 wt % of zirconium and 0.01 to 0.05 wt % of yttrium and/or with 0.05 to 0.2 wt % of cerium, and for the platinum-rhodium alloy to be a PtRh10 alloy, the platinum-gold alloy to be a PtAu5 alloy and the platinum-iridium alloy to be a PtIr(1-10) alloy, especially a PtIr(3-10) alloy (where PtXn means (100-n) wt % Pt and n wt % element X).

The shaped bodies, especially tubes, made by the method according to the invention exhibit the aforesaid surprising and advantageous characteristics.

The advantageous properties are also true for the use of a glass-refining tube made by the method according to the invention. These are metal tubes used in the known procedures for making glass. During the production of glass it is inevitable that gas bubbles are present in the glass melt which, if left in the melt, will appear in or otherwise disturb the quality of the finished product. These bubbles are removed by glass-refining, by inserting tubes which must be resistant to the molten glass, into the melt to release the gas bubbles. The present invention provides a method for making tubes of especially advantageous properties for this purpose.

The invention will be explained by the following example.

EXAMPLE

A sheet (dimensions: 400 mm long, 350 mm wide, 3 mm thick) of unoxidized platinum material doped with 0.18 wt % zirconium and 0.017 wt % yttrium is rounded and welded without filler metal over its length, in order to make in this way a tube blank with a length of 400 mm and an inside diameter of about 111 mm. This tube blank is subjected to heat treatment in an oxidizing medium comprising dry air at a temperature of 1000° C. for a duration of 300 hours, until the oxygen content of the material reaches 0.073 wt %, then is pulled onto a mandrel of hardened tool steel having a diameter of 110 mm, and finally elongated to the desired length and wall thickness. Elongation is accomplished with a drawing mandrel. The tube blank is formed to a wall thickness of 0.7 mm and a length of 1500 mm.

To make tubes of even larger dimensions, the tube can contain a plurality of longitudinal or also circumferential welds. With commercial roll-pressure machines, tubes with diameter up to about 650 mm and length up to about 8000 mm can be made in this way, which values must not be regarded as limitative.

It will be appreciated that the instant specification is set forth by way of illustration and not limitation and that various modifications and changes may be made without departing from the spirit and scope of the present invention.

What is claimed is:

1. A method for manufacturing a welded shaped body of platinum material dispersion-hardened by finely divided small particles of base metal oxide, and wherein the base metal oxide is one or more oxides of the elements yttrium, zirconium and cerium, the method comprising the following process steps:

(a) shaping and welding of at least one part of an alloy of platinum and base metal, to a preform body, (b) heat treating the preform body in an oxidizing medium until the minimum degree of oxidation of the base metal reaches 75 wt %, (c) forming the preform body.

2. A method according to claim 1, wherein the part being shaped and welded is a sheet, and the preform body is a tube.

3. A method according to claim 1, wherein the formed preform body is subjected to recrystallization annealing treatment.

4. A method according to claim 3, wherein the annealing treatment is performed at a minimum temperature of 600° C.

5. A method according to claim 4, wherein the annealing treatment is performed at a maximum temperature of 1400° C.

6. A method according to claim 1, wherein the forming of the preform body comprises elongating the preform body to cause a reduction of at least 50% in wall thickness to be achieved.

7. A method according to claim 1, wherein the base metal content of the alloy comprising platinum and base metal is 0.005 to 1 wt %.

8. A method according to claim 1, wherein the dispersion-hardened platinum material comprises dispersion-hardened platinum-rhodium alloy, dispersion-hardened platinum-iridium alloy or dispersion-hardened platinum-gold alloy.

9. A method according to claim 1, wherein the alloy comprising platinum and base metal is doped with 0.1 to 0.2 wt % of zirconium and 0.01 to 0.05 wt % of yttrium and/or with 0.05 to 0.2 wt % of cerium.

10. A method according to claim 9, wherein the dispersion-hardened platinum material is a PtRh10 alloy.

11. A method according to claim 9, wherein the dispersion-hardened platinum material is a PtAu5 alloy.

12. A method according to claim 9, wherein the dispersion-hardened platinum material is a PtIr(1-10) alloy.

13. A shaped body made by a method for manufacturing a welded shaped body of platinum material dispersion-hardened by finely divided small particles of base metal oxide, and wherein the base metal oxide is one or more oxides of the elements yttrium, zirconium and cerium, the method comprising the following process steps:

(a) shaping and welding of at least one part of an alloy of platinum and base metal, to a preform body, (b) heat treating the preform body in an oxidizing medium until the minimum degree of oxidation of the base metal reaches 75 wt %, (c) forming the preform body into said shaped body.

14. The shaped body of claim 13 which is a glass-refining tube.

15. In a method of refining glass including melting the glass and removing gas bubbles from the melt, the improvement wherein a glass-refining tube according to claim 14 is inserted into the melt to remove the gas bubbles.

* * * * *